US006620117B1

(12) United States Patent
Johnson et al.

(10) Patent No.: US 6,620,117 B1
(45) Date of Patent: Sep. 16, 2003

(54) VIBRATIONAL DEVICE FOR STIMULATING TISSUE AND ORGANS

(75) Inventors: Stephen C. Johnson, Salt Lake City, UT (US); Richard M. Greenwald, Kingstown, RI (US); Thomas D. Rosenberg, Salt Lake City, UT (US)

(73) Assignee: Connextech, L.L.C., Salt Lake City, UT (US)

( * ) Notice: Subject to any disclaimer, the term of this patent is extended or adjusted under 35 U.S.C. 154(b) by 0 days.

(21) Appl. No.: 09/488,081

(22) Filed: Jan. 20, 2000

(51) Int. Cl.[7] ..... A61H 7/00

(52) U.S. Cl. ..... 601/90; 601/84; 601/93

(58) Field of Search ..... 601/49, 60–61, 601/27–33, 23, 24, 26, 84, 89–93, 97, 98, 100–101, 104; 472/95, 96, 102, 103; 5/108, 109

(56) References Cited

U.S. PATENT DOCUMENTS 3,119,125 A * 1/1964 Hayes ..... 5/109
3,581,739 A * 6/1971 Brandt et al. ..... 601/5
3,890,953 A 6/1975 Kraus et al.

(List continued on next page.)

OTHER PUBLICATIONS

Brown, Thomas D. et al., Toward an Identification of Mechanical Parameters Initiating Periosteal Remodeling: A Combined Experimental and Analytic Approach, vol. 23, Journal of Biomechanics, pp. 893–905, 1990.

Nokes, Leonard D.M. et al., A Literature Review of Vibrational Analysis of Human Limbs, vol. BME–31 IEEE Transactions of Biomedical Engineering, pp. 187–192, 1984.

Rubin, Clinton T. et al., Regulation of Bone Formation by Applied Dynamic Loads, vol. 66–A, The Journal of Bone and Joint Surgery, pp. 397–402. 1984.

Rubin, Clinton T. et al., Osteoregulatory Nature of Mechanical Stimuli: Function as a Determinant for Adaptive Remodeling in Bone, vol. 5, Journal of Orthopaedic Research, pp. 300–310, 1987.

Usui, Yasuo et al., Different Effects of Mechanical Vibration on Bone Ingrowth into Porous Hydroxyapatite and Fracture Healing in a Rabbit Moel, vol. 7, Journal of Orthopaedic Research, pp. 559–567, 1989.

McLeod, Kenneth J. et al., The Effect of Low–Frequency Electrical Fields on Osteogenesis, vol. 74–A, The Journal of Bone and Joint Surgery, pp. 920–929, 1992.

Orthofix fixators Modulsystem, catalogue.

*Primary Examiner*—Justine Yu
(74) *Attorney, Agent, or Firm*—Clayton, Howarth & Cannon, P.C.

(57) ABSTRACT

An apparatus for mechanically stimulating a human user includes in one embodiment a base frame, a rigid plate connected to the base frame and having an area sufficient to support a standing human, a vibrational device attached to the bottom of the horizontal plate whereby the plate is caused to oscillate in both vertical and horizontal directions at a desired frequency with an amplitude of less than 2.0 mm, and a frequency control device whereby the frequency of the vertical and horizontal oscillations may be selectively and independently adjusted. Vertically extending handrails are preferably connected to the device such that vibrations may be transmitted to the arms and upper spinal region of a user's body when grasped.

12 Claims, 8 Drawing Sheets

U.S. PATENT DOCUMENTS 3,911,907 A * 10/1975 Smith, Jr. ..... 482/1
3,915,151 A 10/1975 Kraus
4,061,137 A * 12/1977 Sandt ..... 601/86
4,066,065 A 1/1978 Kraus
4,105,017 A 8/1978 Ryaby et al.
4,151,839 A * 5/1979 Schwarz ..... 601/104
4,266,532 A 5/1981 Ryaby et al.
4,266,533 A 5/1981 Ryany et al.
4,306,564 A 12/1981 Kraus
4,343,303 A 8/1982 Williams
4,430,992 A * 2/1984 Christ ..... 601/53
4,530,360 A 7/1985 Duarte
4,538,596 A 9/1985 Colasante
4,586,492 A * 5/1986 Manahan ..... 601/90
4,710,655 A 12/1987 Masaki
4,753,225 A 6/1988 Vögel
4,782,822 A 11/1988 Ricken
4,858,599 A 8/1989 Halpern
4,858,998 A 8/1989 Welschof et al.
4,873,966 A 10/1989 Gitter
5,046,484 A 9/1991 Bassett et al.
5,070,555 A * 12/1991 Pearson et al. ..... 5/600
5,088,473 A * 2/1992 Chen et al. ..... 601/26
5,103,806 A 4/1992 McLeod et al.
5,191,880 A 3/1993 McLeod et al.
5,273,028 A 12/1993 McLeod et al.
5,376,065 A 12/1994 McLeod et al.
5,716,331 A * 2/1998 Chang ..... 601/50
5,910,123 A * 6/1999 Wang ..... 601/50
6,256,397 B1 * 7/2001 Komatsu ..... 381/396

* cited by examiner

VIBRATIONAL DEVICE FOR STIMULATING TISSUE AND ORGANS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. The Field of the Invention

This invention relates to an apparatus and method for vibrationally stimulating a human body. More particularly, the present invention relates to an apparatus and method for mechanically stimulating tissues and organs, including bone tissue and soft tissue in the legs, arms and spinal region of a human user, as well as skin, ears, nose, throat, vascular structures, muscles and joint regions including ligaments, tendons, articular cartilage, and the cardiovascular system and venous circulation, by applying mechanical vibration to the user's body.

2. Description of Related Art

It is known to encourage bone growth with vibration and impact devices. For example, U.S. Pat. No. 5,273,028 to Kenneth J. McLeod discloses an apparatus for stimulating bone growth in a living organism such as a human by transmitting vertical vibrations through a plate upon which the person stands. U.S. Pat. Nos. 5,103,806, 5,376,065, and 5,191,880, also to McLeod, claim methods for preventing osteopenia, and promoting growth, ingrowth, and healing of bone tissue including bone fractures, through the step of subjecting bone to a mechanical load. U.S. Pat. No. 5,046,484 to Bassett et al. describes a method of providing passive exercise treatment to increase the size and strength of bone by transmitting vertical impact loads to the heel of a patient. U.S. Pat. No. 4,858,599 to Halpern claims a similar method for the prevention or alleviation of osteoporosis. U.S. Pat. No. 4,782,822 to Ricken describes a resonance frequency stimulator for increasing blood circulation in horses comprising a vibrating platform upon which a horse is made to stand, and which vibrates at the resonant frequency for the horse being treated.

The devices currently known in the art are typically focused on a concentrated stimulation of bone tissue through vertical vibration. The McLeod patents, for example, suggest vertical vibration with optimal ranges of load and vibration frequency. In addition to these limitations, the devices currently known in the art do not utilize horizontal vibration or address the concept of independent control of vertical and horizontal motion.

The prior art is thus characterized by several disadvantages that are addressed by the present invention. The present invention minimizes, and in some aspects eliminates, the above-mentioned failures, and other problems, by utilizing the methods and structural features described herein.

BRIEF SUMMARY AND OBJECTS OF THE INVENTION

It is therefore an object of the present invention to provide a vibrational conditioning and/or therapeutic therapy device.

It is yet another object of this invention, in accordance with one aspect thereof, to provide such a device for home use that is easy to operate.

It is an additional object of the present invention, in accordance with one aspect thereof, to provide such a device that provides horizontal vibrations as well as vertical vibrations.

It is another object of this invention, in accordance with one aspect thereof, to provide such a device that provides both horizontal and vertical vibrations that may be operated independently of each other, and are independently controllable as to frequency.

It is another object of this invention, in accordance with one aspect thereof, to provide such a device that is relatively low to the ground for ease of stepping onto and off of the base platform.

It is another object of this invention, in accordance with one aspect thereof, to provide such a device that includes handrails for assisting the user in stepping onto and off of the base platform.

It is yet another object of this invention, in accordance with one aspect thereof, to provide such a device that includes vibrational handrails that will impart vertical vibration to the arms and upper body of the user when grasped.

It is still another object of this invention, in accordance with one aspect thereof, to provide such as device that permits more versatility to the user for composing vibrational treatments of tissues and organs, including bone tissue and soft tissue in the legs, arms and spinal region of a human user, as well as skin, ears, nose, throat, vascular structures, muscles and joint regions including ligaments, tendons, articular cartilage, and the cardiovascular system and venous circulation of the user.

The above and other objects are realized in an apparatus for mechanically stimulating a human user comprising a base frame, a rigid plate or platform connected to the base frame and having an area sufficient to support a standing human, vibration means attached to the bottom of the horizontal plate whereby the plate oscillates in both vertical and horizontal directions at a desired frequency within an amplitude of preferably 2.0 millimeters or less, and frequency control means whereby the frequency of the vertical and horizontal oscillations may be selectively and independently adjusted. Hand rails are preferably connected to the device such that vibrations may be transmitted to the arms and upper spinal and head regions of a user's body when grasped.

Some of the above objects are also realized in a unique method for using the above-referenced apparatus for mechanically stimulating tissues and organs, including bone tissue and soft tissue in the legs, arms and spinal region of a human user, as well as skin, ears, nose, throat, vascular structures, muscles and joint regions including ligaments, tendons, articular cartilage, and the cardiovascular system and venous circulation, by applying mechanical vibration to the user's body. Such vibrational stimulation may also improve the digestive system and bowel habits.

The ability of the device disclosed herein to accomplish the objectives is significant. Horizontal vibration provided by applicants' home-use device may be desirable for improving cartilage nutrition in joints, for alleviating joint pain, stimulating articular cartilage in hip, ankle, and knee joints, for example, and other joints, and for stimulating muscle compartments including their vascular elements. In addition, bending the knee joint through various knee flexion angles during vibrational treatment will achieve wider stimulation of weight-bearing zones and may be helpful in the treatment of osteoarthritis. It would therefore be desirable to have a device and method that combines vertical vibration with horizontal vibration to provide these benefits. Such a method would be beneficial for the treatment of tissues and organs, including bone tissue and soft tissue in the legs, arms and spinal region of a human user, as well as skin, ears, nose, throat, vascular structures, muscles and joint regions including ligaments, tendons, articular cartilage, and the cardiovascular system and venous circulation. The benefits to articular cartilage may be provided either with or without osteogenic or chondroprotective agents.

Applicants' vibrational conditioning and/or therapeutic therapy device will allow independent control of the presence and frequency of vibrations in both the vertical and horizontal dimensions. This will allow the selection of an appropriate vibration regime, whether it involves vertical vibration alone, horizontal vibration alone, or both vertical and horizontal vibrations simultaneously.

Still further, the prior art devices do not achieve adequate vibration of the upper spinal region or the head region, nor of the upper extremities where osteoporosis and associated fractures are a major health risk. When a user stands or even sits upon vibrating platforms as taught by the prior art, the mass of the user's body dampens the vibrations before they reach more distant regions of the upper body. Thus the benefits of vibrational loading of bone and connective tissue are attenuated in those regions. A preferred vibrational conditioning and/or therapeutic therapy device will provide means whereby the arms and upper spinal region of the body may be stimulated directly, without the dampening caused by transmission of the vibrations from a distant region of the body. Such a novel configuration allows more direct treatment of the shoulder, elbow, and wrist joints, and the bones of the upper extremities, and also allows more direct treatment of the thoracic and cervical regions. Stimulation of the wrist region may be beneficial in the treatment of osteoporosis in the distal radius.

Additionally, many of the prior art devices specify a resonant frequency for the vibrations. In these devices either the device must make calculations to determine the resonant frequency of the combined mass system of the device and the patient combined, or a feedback system is required whereby forces or accelerations are monitored. These fixed range systems are often cumbersome and expensive, and are unnecessarily limited. Such fixed range devices are also unsuited to home use by virtue of their expense and limited application. A preferred vibrational conditioning and/or therapeutic therapy device will be simple for a user to operate, even in their own home, without the need for involved calculations or the addition of complicated feedback and control mechanisms.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
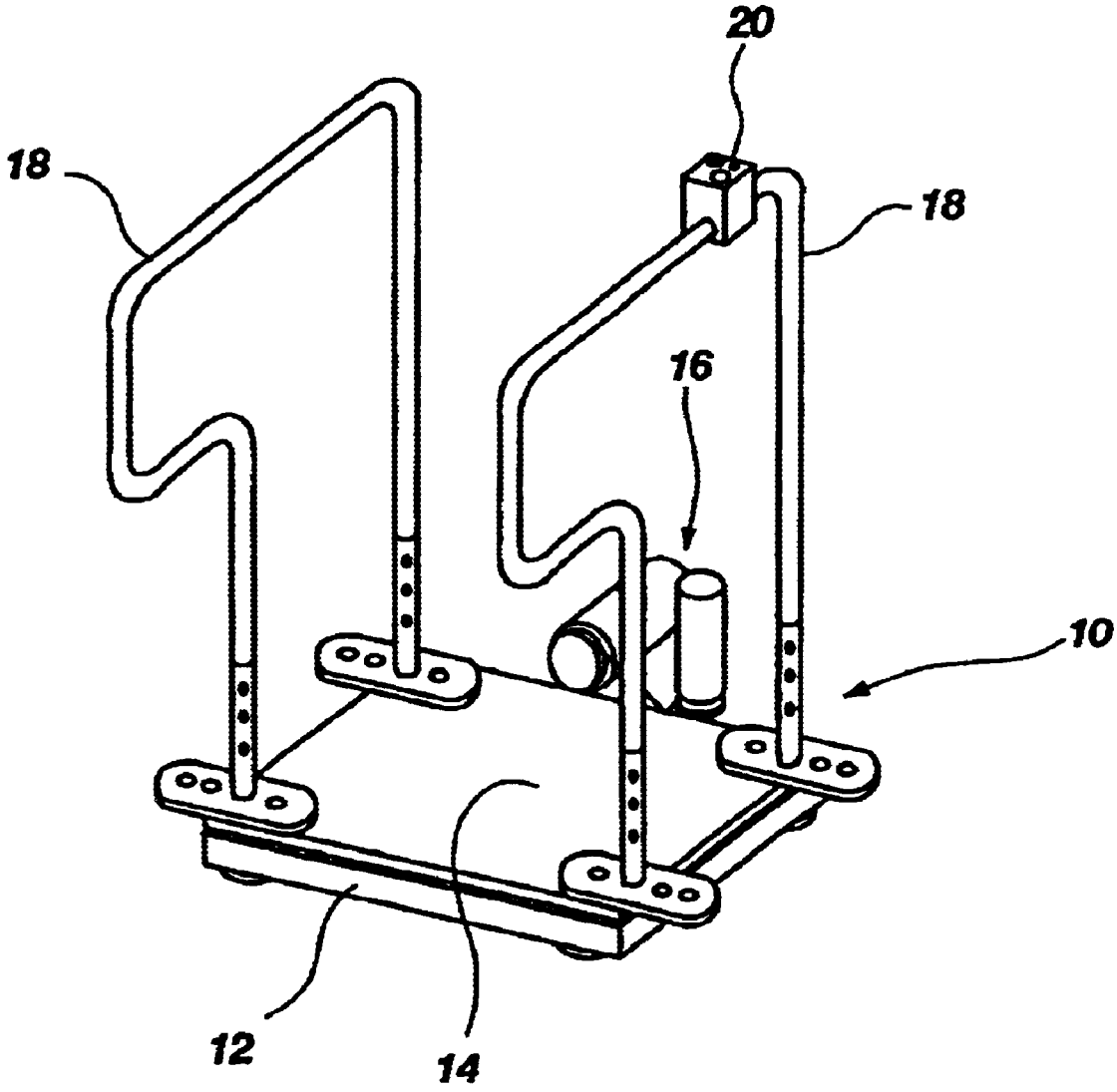
FIG. 1 provides a pictorial view of the vibration apparatus of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Applicants have found that various aspects of the human body can be positively affected by mechanical vibrational stimulation. Vibrational energy imparted to the human body positively influences the circulatory system and musculature so as to stimulate venous circulation. Vibration therapy may help prevent venous thrombosis when applied after surgery, and can be used in aftercare treatment of those suffering from conditions such as venous thrombosis, osteoporosis and osteoarthritis. Other benefits of vibration therapy in accordance with the invention include the stimulation of hard tissue growth, soft tissue growth, articular cartilage growth, simulation of the workings of the cardiovascular system, ears, nose and throat, inducing positive muscle relaxation in a human user, and contribution to the nutrition of articular cartilage.

Applicants have developed a concept for imparting vibrational energy to a human user that is sufficiently compact for use in the home. Importantly, the device provides horizontal and vertical vibration to the legs and arms. The term "vibration" as used herein shall refer to a rapid, reciprocating linear motion about an equilibrium position, or a rapid orbital motion about an axis, as well as any other suitable concept consistent with the known meaning of "vibration" in the field of physics.

It is to be understood that although applicants presently envision the invention as preferably a home-use apparatus, the apparatus may of course by designed and used as a medical, in-office device.

Referring now to FIG. 1, there is shown a general pictorial view of one embodiment of the present invention. The vibrational conditioning and/or therapeutic therapy device, denoted generally at 10, comprises a frame 12 designed for placement on a floor surface, a horizontal vibrational plate or platform 14, motors 16 for driving the vibrational plate, and vertical handrails 18*a*–18*b*. The horizontal plate or platform 14 has an area sufficient to support a standing human and is preferably less than nine square feet, and more preferably less than four square feet. The handrails 18*a*–18*b* are preferably of a height that is comfortable for gripping by a person standing on the plate.

It is to be understood that the handrails 18*a*–18*b* may instead comprise a single handrail or several handrails if desired, and may be of adjustable or fixed height. The handrails 18*a*–18*b* may in fact be designed to stand high so as to be gripped at their upper portion by a user's fully upwardly-extended arms, such that, in the case of a very tall person, the handrails 18*a*–18*b* could be approximately 10 feet above the floor on which the base plate 12 resides. A presently preferred arrangement is to position the handrails such that they can be gripped by a user standing on the plate or platform 14 with the arms bent at the elbows and extending somewhat horizontally, such that the height of the handrails 18*a*–18*b* would be perhaps three or four feet above the floor on which the base plate 12 resides. The handrails may even be placed a mere two feet above the platform 14, or even only a few inches above the platform 14, to require a user to bend over when standing on the platform 14 in order to grip the handrail 18*a*, for example, if desired as part of a particular therapy regime for that user.

A control box 20 for controlling the speed of the motors, preferably independently, may also be attached to the handrails for convenience. When the device is in use, the user 22 typically stands on the platform 14, holding the handrails 18, and experiences mechanical vibration in the vertical and/or horizontal directions. It will be apparent that the platform 14 need not necessarily be flat and horizontal as shown, but may also be inclined at some angle if desired, and may comprise a curved plate for certain therapeutic uses.

Figure 2:
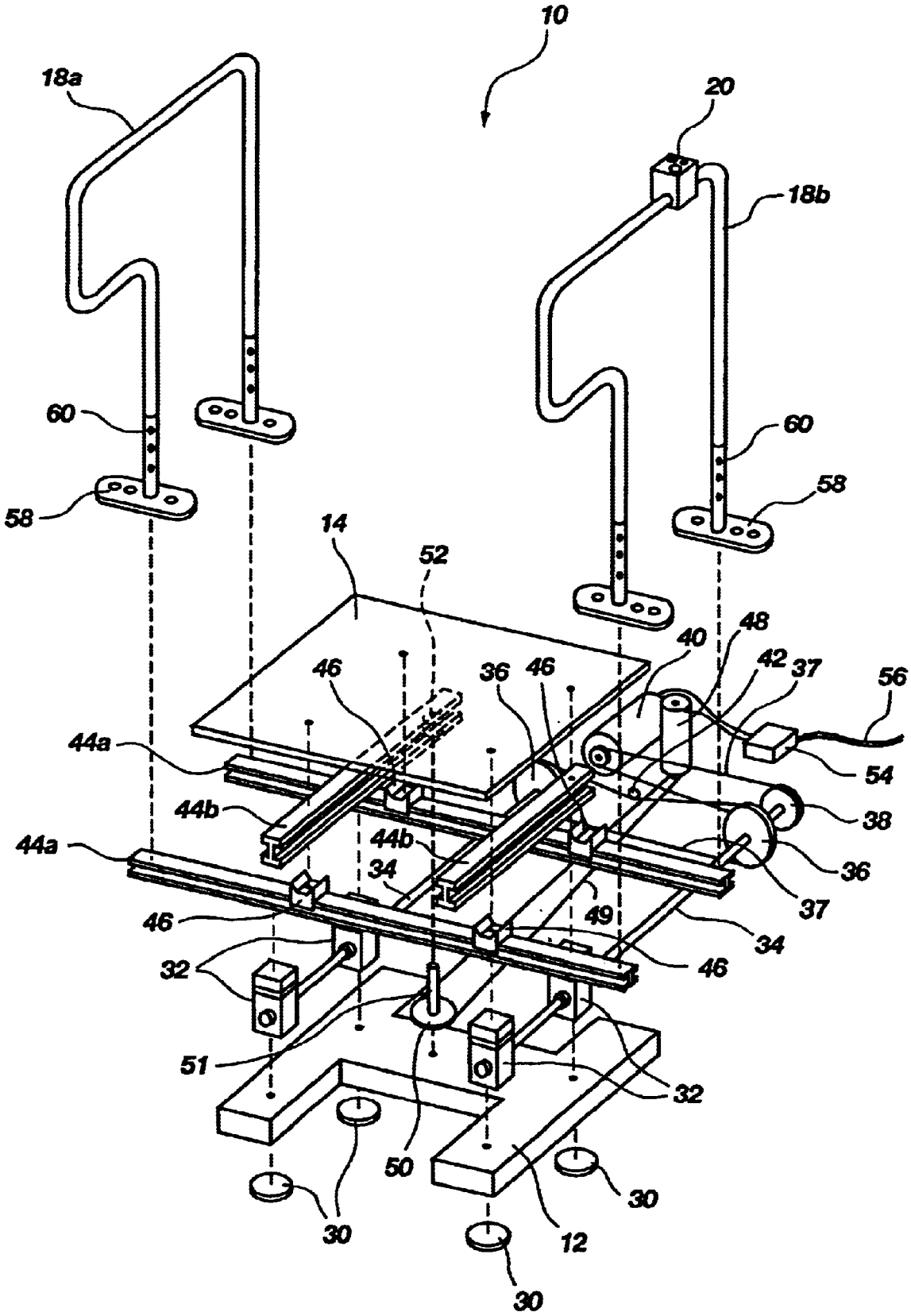
FIG. 2 shows an exploded view of a preferred embodiment of the present invention.

FIG. 2 shows an exploded view of the preferred embodiment of the present invention. From this view the structure of the invention becomes more clear. The base frame 12 is designed for placement on a floor surface, and typically includes resilient or elastomeric shock mounts 30. These mounting pads serve as shock absorbing feet for the apparatus, and are preferably made of a rubberized material that will prevent the device from sliding about.

At least four support blocks 32 are rigidly connected to the base 12. The blocks 32, sometimes called "pillow blocks" and referred to herein also as push-up means, contain bearings mounted within them which have their center hole 0.25 mm to 1.0 mm off-center, and cam followers as known to those skilled in the field of cam workings. When the support block bearing is rotated, it creates a cam effect that raises and lowers the top of the block for each revolution of the bearing, as known to those skilled in the use and operation of pillow blocks. These bearings are rotated by parallel shafts 34, preferably positioned in a horizontal orientation, which pass through the two rearmost support blocks, and terminate at two frontmost support blocks. It is advantageous for an optimal performance of the invention that the support blocks be aligned to accept the shafts, unless some other structure is provided to compensate for a non-straight alignment. It will also be apparent that more than two parallel shafts could be used to connect a larger number of support blocks if desired.

The rearward ends of the shafts 34 terminate at sprockets 36 and 38, which are driven by belts 37, which are in turn driven by a variable speed vertical drive motor 40. The speed of this motor may be selectively adjusted via the control box 20. An idler sprocket 42 may be provided to ensure adequate tension to the belts, by operating to push down upon the belts 37 and thereby remove unwanted slack. It will be apparent that the relative size of the sprockets 36 and 38 will depend upon the power and operating speed range of the motor 40, and upon the desired vibrational frequency range for the device. It will also be apparent that the sprockets 36 which are directly connected to the shafts 34 will preferably be identical in size in order to transmit the same rotational speed to the shafts 34. Otherwise, the pillow blocks 32 will produce irregular or unsynchronized vertical motion, which may produce unwanted stress in the mechanical components of the device, and will cause the plate to tilt and roll in its vertical vibration. Such motion could be desirable in some circumstances, but is normally undesirable.

Rigidly mounted to the tops of the support blocks 32 are at least two horizontally planar parallel rails 44*a*. These rails extend from beyond the left side of the platform 14 to beyond the right side of the plate in order to accommodate the connection of the handrails 18. On top of the rails 44*a* are slidable connectors 46 which allow side to side sliding motion along the rails. To allow orbital motion of the platform 14, a second group of horizontally planar parallel rails 44*b* are provided, these being aligned orthogonally to the first rails and located between the first group of rails 44*a* and the platform 14. This additional pair of rails are slidably connected to the first rails 44*a* by the sliding connectors 46, and are fixedly connected to the plate 14 so as to allow rotational motion of the shaft 51 to impart horizontal orbital motion to the plate 14 due to simultaneous orthogonal sliding reciprocation of the second rails 44*b* on the first rails 44*a*. It will be appreciated that the second group of rails 44*b* will necessarily have a length greater than the greatest distance between any two of the first rails.

The rails 44*a* and 44*b* are preferably formed with a "T" or "I" beam cross-sectional shape as shown, so as to provide flanges for the connection of the sliding connectors 46. The sliding connectors 46 may be any adequately strong, low friction sliding mechanism configured to mate with the flange of the rails 44*a* and 44*b*, preferably comprising roller bearings. It will be apparent that connectors 46 must be provided with structure that wraps around the rail flanges so as to prevent the sliding connectors from separating from the rails when the apparatus is subjected to rapid up and down motion. Additionally, more than four sliding connectors may be provided, the precise number depending upon the strength and rigidity of the plate 14 and the strength of the connectors themselves. Similarly, it will be apparent that the required strength of the horizontal plate 14 depends upon the number of and distance between the second rails 44*b*, which distance in turn depends upon the number of rails incorporated into the device.

Horizontal orbital oscillation is transmitted to the plate 14 by means of a variable speed drive motor 48 which is connected to an orbital motion drive sprocket 50 via a belt 49. As with the vertical drive motor, the speed of the orbital motion drive motor may be selectively adjusted via the control box 20. The sprocket 50 transmits rotational motion via a shaft 51 to a cam device 52 that is connected to the bottom of the plate 14. The cam device converts the rotation of the shaft into oscillation of the plate 14, causing it to slide back and forth along both sets of rails. The operation of the cam device 52 is in accordance with any suitable cam known to those of ordinary skill in the workings of cam devices.

It will be appreciated that the device 10, by operation of the variable-speed drive motors 40 and 48, is as such a "fixed-setting" or "open loop" vibrational device in that the vibrational force is not of necessity fully dependent on the mass of the user or of any of the loading involved. This is in contrast to prior art "fixed-range" or "closed loop" vibrational devices which involve complex automatic feedback control adjustment of the vibrational amplitude and frequency.

A "fixed-range" or "closed loop" vibrational device, unlike the present invention, will monitor and feed back information to the controller to achieve a desired amplitude or frequency target. Such prior art devices thereby automatically vary the settings but fix the target frequency range, as opposed to the present invention which fixes the setting and thereby allows the frequency range to vary with the loading involved for a particular user. The "fixed-setting" or "open loop" vibrational device 10 of the present invention preferably operates by a fixed initial setting that involves no automated feedback or other automatic adjustment. Rather, the frequency is adjusted with the manually-operable control box 20 by the user, by either increasing or decreasing the speed of one or both of the variable speed motors 40 and 48 to thereby modify the frequency of the vibration.

The control box 20, or some other suitable structure, may also be designed to permit the user to selectively, manually, modify an amplitude of the vibrational movement of the plate 14, in accordance with principles known to those of ordinary skill in the relevant field. Selectively modifying an amplitude of vertical vibration, or of orbital horizontal vibration, or of linear horizontal vibration, is within the scope of the present invention.

Figure 5:
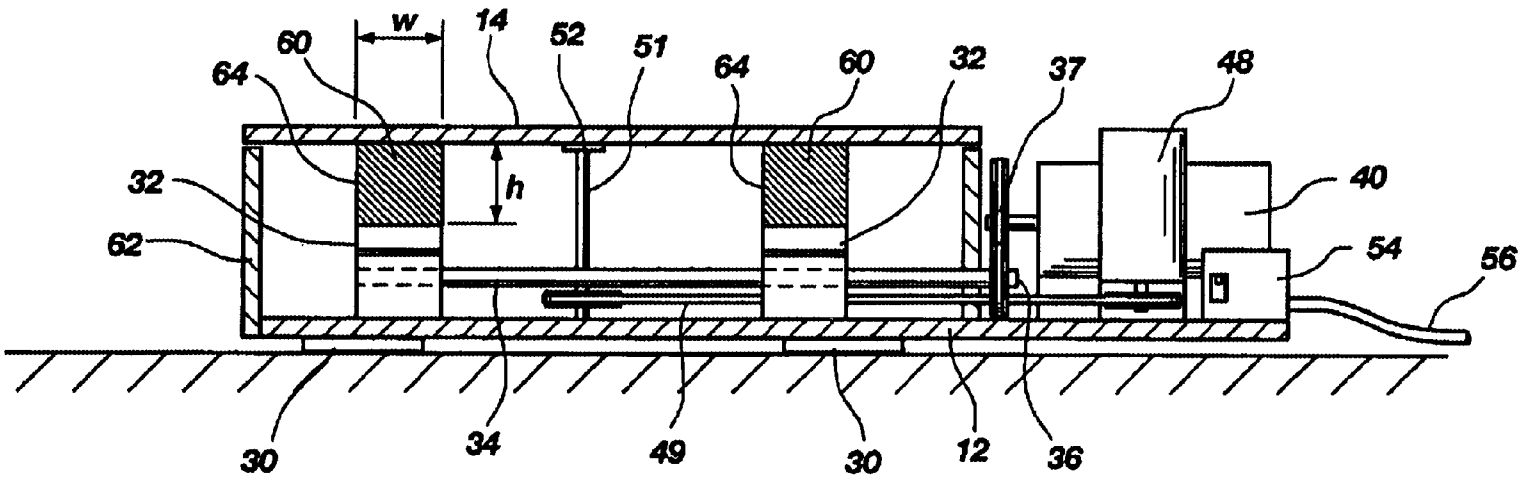
FIG. 5 is a side sectional view of an alternative embodiment of the present invention incorporating resilient bearing pads directly supporting the oscillating horizontal plate.

It will be appreciated that other methods of providing horizontal orbital motion of the plate 14 may also be employed. For example, as shown in FIG. 5, the plate 14 may be directly mounted on the pillow blocks 32 by means of resilient bearing pads 64, which may flex as desired to allow horizontal orbital motion of the plate relative to the stationary pillow blocks, while also supporting the weight of the plate and a user. It will be apparent that other means of imparting horizontal oscillation may also be devised by one skilled in art.

The device is powered by ordinary household alternating current (AC), delivered via power cord 56. In the preferred embodiment the drive motors 40 and 48 operate on direct current (DC), and the power cord is thus connected to power transformer means 54 which converts the household AC to DC. The transformer means is preferably located somewhere near the drive motors. It will be appreciated that other alternative motor and power supply arrangements may be devised by those skilled in the art without departing from the spirit and scope of the present invention.

Attached to the left and right extremities of the first set of rails 44a are hand rails 18 fixedly connected to and extending upwardly from the rails on the right side and on the left side of the plate 14. These handrails are provided with horizontal adjustment means 58 and vertical adjustment means 62 such that the rails may be adjusted to a convenient and comfortable height and width for grasping by a user standing on the top of the plate. Because the handrails are preferably connected only to the first rails 44*a*, which are in turn fixedly connected to the top of the support blocks 32, primarily vertical oscillation is transmitted to the handrails, such that when grasped by a user, primarily vertical vibration of the upper body is caused. However, it will be apparent that when operating to provide horizontal oscillation only, horizontal motion may also be imparted by the handrails 18, by any suitable means desired.

In the preferred embodiment, the control box 20 is mounted to the handrails 18 for convenience and ease of operation. The control box will preferably be provided with means for independently controlling the vertical drive motor and the horizontal drive motor such that the desired frequency of vibration, or no vibration at all, may be selectively adjusted. Thus the user may choose vertical vibration only, horizontal vibration only, or both vertical and horizontal vibration simultaneously. It will be appreciated that the device may be used to transmit vertical vibration to the upper body of a user with the user standing on the floor adjacent to the machine, such that no vibration is directly transmitted to the lower body. Similarly, the user may stand on the plate 14 without grasping the handrails such that any vibrations transmitted to the upper body are dampened by the user's lower body.

Figure 3:
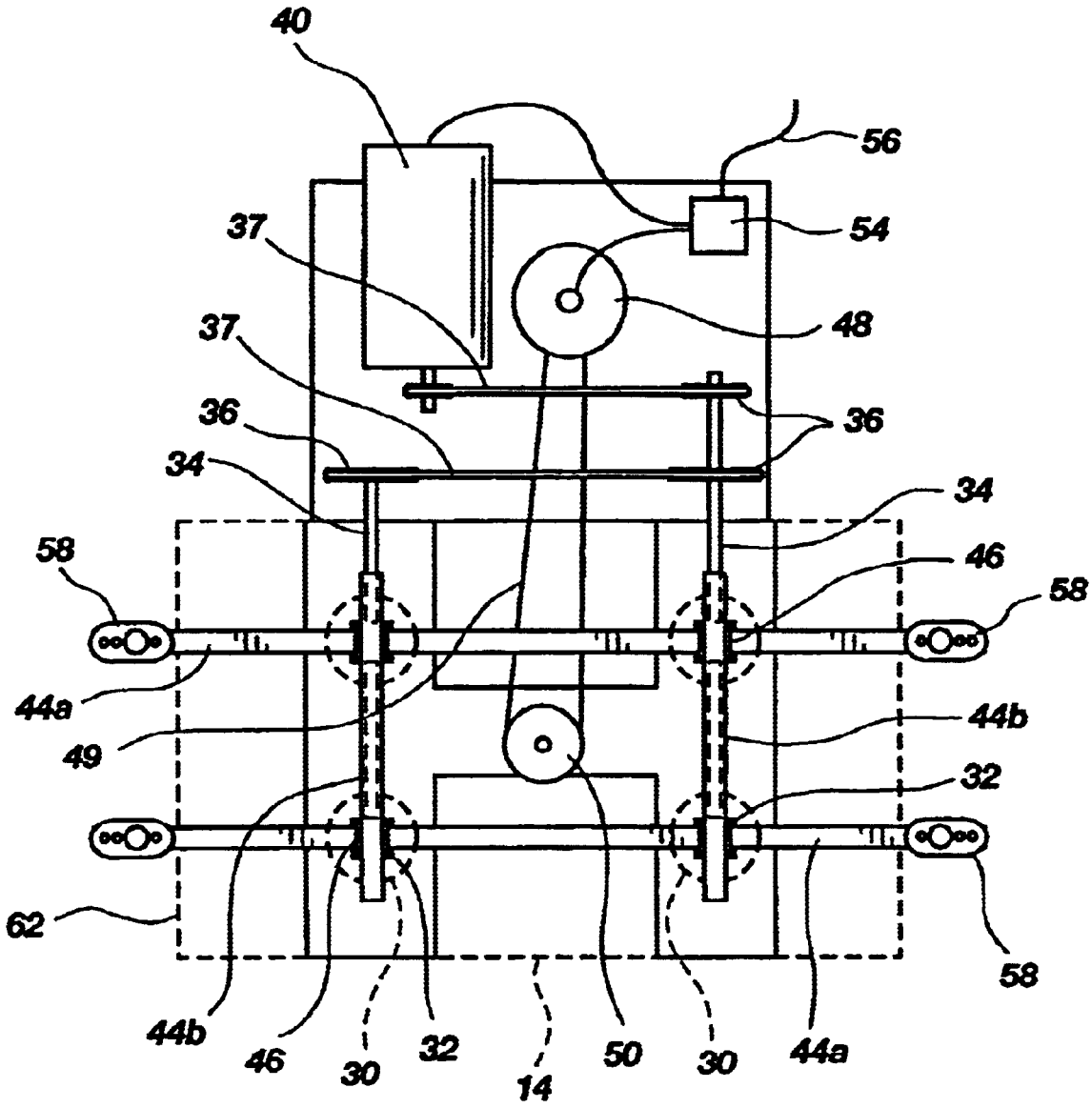
FIG. 3 provides a top view of the present invention with the horizontal plate removed, showing the interior mechanical configuration.

FIG. 3 provides a top view of the present invention assembled, but with the horizontal plate removed, showing the interior mechanical configuration. The outline of the plate 14 is shown dashed in this view. Here the frame 12, support blocks 32, rotational shafts 34, rails 44*a*, and 44*b*, slidable connectors 46, and drive motors 40 and 48 are clearly shown in their assembled configuration. The connection of the handrail mounts 58 are also shown at the right and left extremes of the rails 44*a*.

Figure 4:
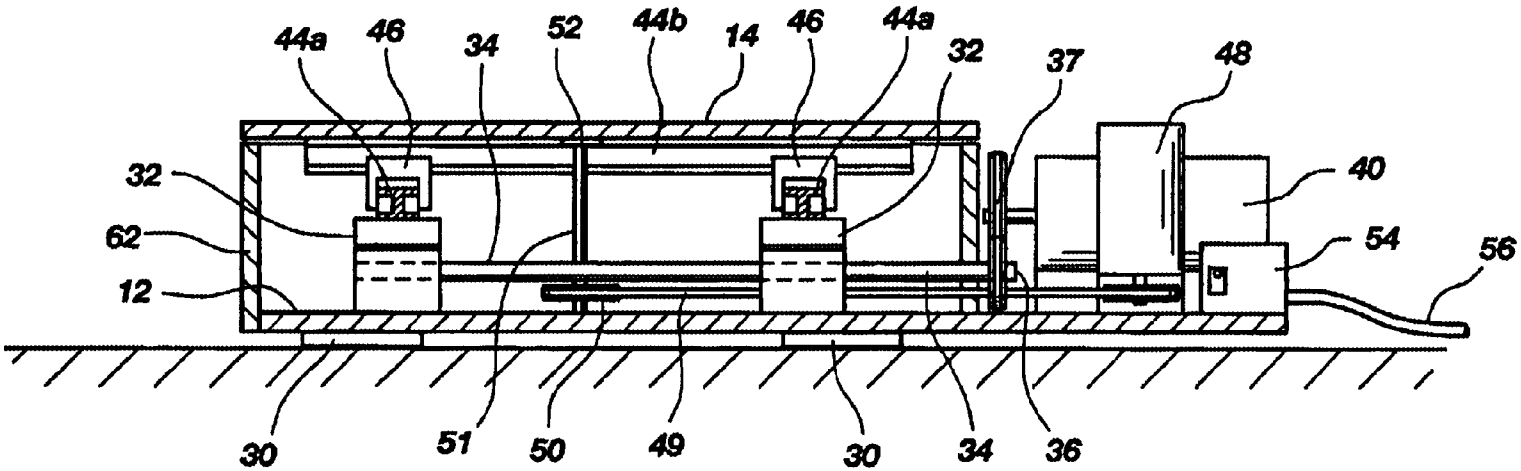
FIG. 4 is a sectional view of the preferred embodiment of the present invention showing a side view of the interior mechanical works.

A vertical skirt 62 is preferably provided around the perimeter of the plate 14 to conceal the inner mechanical apparatus. In FIG. 4 this skirt is more clear. FIG. 4 provides a right side sectional view of the present invention showing the interior mechanical works. Here the preferred arrangement of the frame 12, support blocks 32, shafts 34, rails 44*a* and 44*b*, the sliding connectors 46, and horizontal plate 14 is shown. Of particular interest, it will be clear from this view that the sliding connectors 46 comprise roller bearings, and structure that wraps around the proximal flanges of the rails 44*a* and 44*b*. In this configuration the connectors will slide freely on the rails and adequately support the weight of the user, while at the same time resisting dynamic uplift forces potentially induced by the rapid vertical reciprocation of the pillow blocks 32 and appurtenant structure.

FIG. 5 provides a similar sectional view of an alternative embodiment of the present invention. This embodiment is largely the same as that shown in FIG. 4, except that instead of sliding connectors 46 and rails 44*a* and 44*b*, the underside of the plate 14 is fixedly connected to resilient bearing pads 64, which are in turn fixedly connected to the top moving portion of the pillow blocks 32. These bearing pads are preferably made of a strong, flexible, elastomeric material. The ratio of the height h of the bearing pads 64 to their width w is preferably in the range of 1:1 to 1:5 so that the bearing pads 64 will readily bend and flex in all horizontal directions during oscillation, while still providing adequate vertical support to the plate 14 and user standing thereon.

Figure 6A:
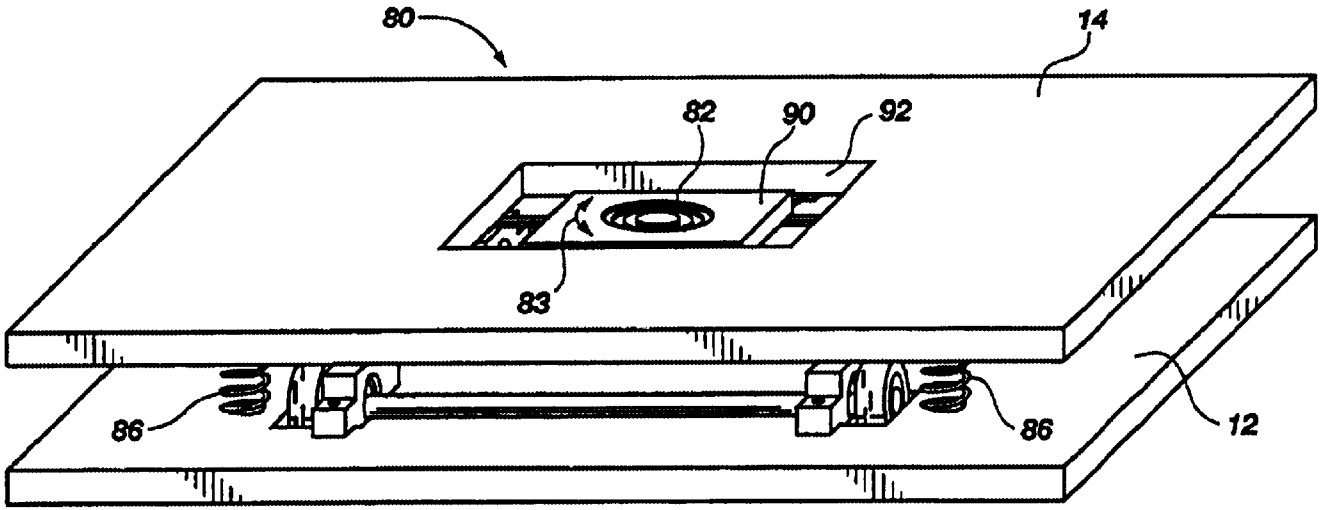
FIG. 6A is a perspective, schematic depiction of another embodiment of the vibration apparatus, made in accordance with the principles of the present invention.
Figure 6B:
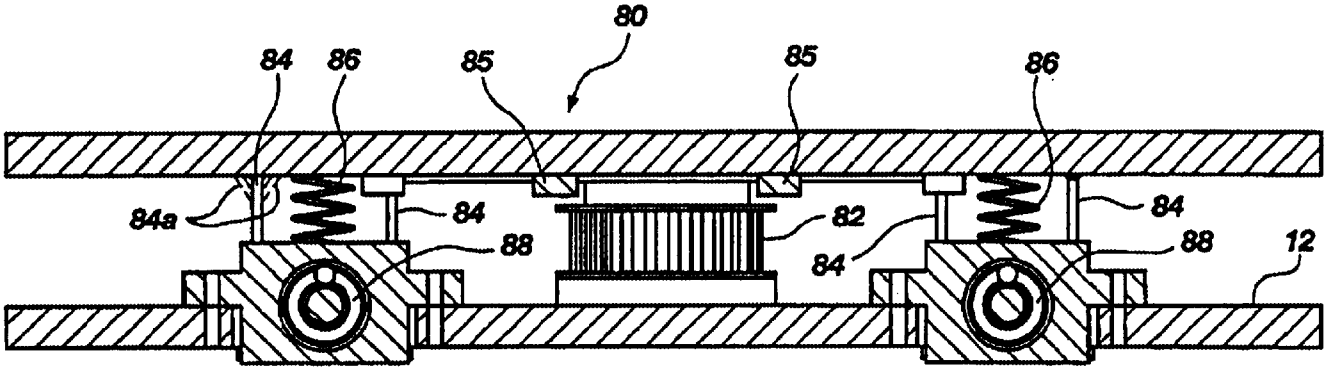
FIG. 6B is a side view of the vibration apparatus of FIG. 6A.

Another alternative embodiment is shown schematically in FIGS. 6A and 6B. There is shown a vibrational conditioning and/or therapeutic therapy device in which the rigid platform 14 is vibrated in horizontal orbital motion by operation of a direct drive center rotating gear 82. The platform 14 is supported by rods 84 having elastic memory and that are flexible enough to buckle elastically during such horizontal vibration, but also have sufficient rigidity to transmit loads to the platform 14 and a user supported upon the platform 14 without failure of said rods 84, as shown in the phantom line depiction of 84*a* in FIG. 6*b*. The rods 84 thus permit both horizontal and vertical motion simultaneously (as explained in additional detail below) without one motion interfering with the other, but can also accommodate horizontal motion without any vertical motion, and vice versa. The rods 84 may be constructed from high tensile strength, non-fatiguing, spring-like steel, such as piano wire, or any other suitable material capable of operating as described.

Vertical vibration is imparted to the platform 14 by eccentric cam-drive devices 88 that operate to raise and lower the platform 14 within a range of 0.25 millimeter to 2 millimeters, to thereby move the platform 14 rapidly upwardly and downwardly in the vertical dimension. Such vertical vibration is preferably imparted by virtue of the load-bearing capabilities of rods 84, which are connected to eccentric cam-drive devices 88, such that rotational movement of the cam-drive devices 88 cause, vertical movement of the rods 84, and therefore the desired vertical displacement of the platform 14, as defined by the eccentricity of cam-drive devices 88. Spring members 86 may be used to dampen the downward movement of the platform 14, and to induce a smooth return of the platform 14 to its original position.

Horizontal orbital movement is produced by the direct drive center rotating gear 82, which rotates in a back-and-forth reciprocating manner as indicated by arrow 83, causing in one embodiment an inner drive block 90 to engage with internal side walls 92 of the platform 14 to thereby drive the platform 14 in a back-and-forth, reciprocating rotational movement path. The inner drive block 90 is preferably coupled to an undersurface of the platform 14 with multiple fastening straps 85.

It will be further appreciated that horizontal linear motion may be provided by the device 10 in any suitable manner. For example, the sprocket 50 and shaft 51 of FIG. 2 could be replaced by a vibrational movement device in which an upwardly extending rod (not shown) is moveable back and forth in a first linear direction and in a second, orthogonal linear direction, instead of the rotational movement provided by shaft 51. Of course, such a vibrational movement device for imparting horizontal linear motion could utilize a first rod for imparting horizontal linear movement in the first linear direction, and a second rod for imparting horizontal linear movement in a second linear direction, for example.

It will be appreciated that the structure and apparatus disclosed herein are merely a few examples of means for causing vibrational movement, and it should be appreciated that any structure, apparatus or system for vibration that performs and functions the same as, or equivalent to, those disclosed herein are intended to fall within the scope of a means for vibrating, including those structures, apparatus or systems for vibrating that are presently known, or which may become available in the future. Anything which functions the same as, or equivalently to, a means for vibrating, in the context of the objectives of the present invention, falls within the scope of this element.

The platform 14 preferably resides less than six inches from the floor when the device 10 resides on the floor, and more preferably less than four inches.

In accordance with the features and combinations described above, a preferred method of [assisting a patient's breathing] mechanically stimulating a human body includes the steps of:

(a) placing a user upon a platform that is less than six inches from the ground, and attaching the user's hands to a handrail extending upwardly from the platform;

(b) selectively vibrating the user's body in a horizontal direction by vibrating the platform;

(c) selectively vibrating the user's body in a vertical direction by vibrating the platform; and (d) selecting adjusting a frequency of horizontal and vertical vibrational movement of the user's body.

The invention further includes the concept and benefits discovered by applicants in vibrating a user while the user's joints reside in flexion. This will now be described in reference to knee flexion, with the understanding that this aspect of the invention involves the vibration of any human joint while the joint is in flexion.

Figure 7:
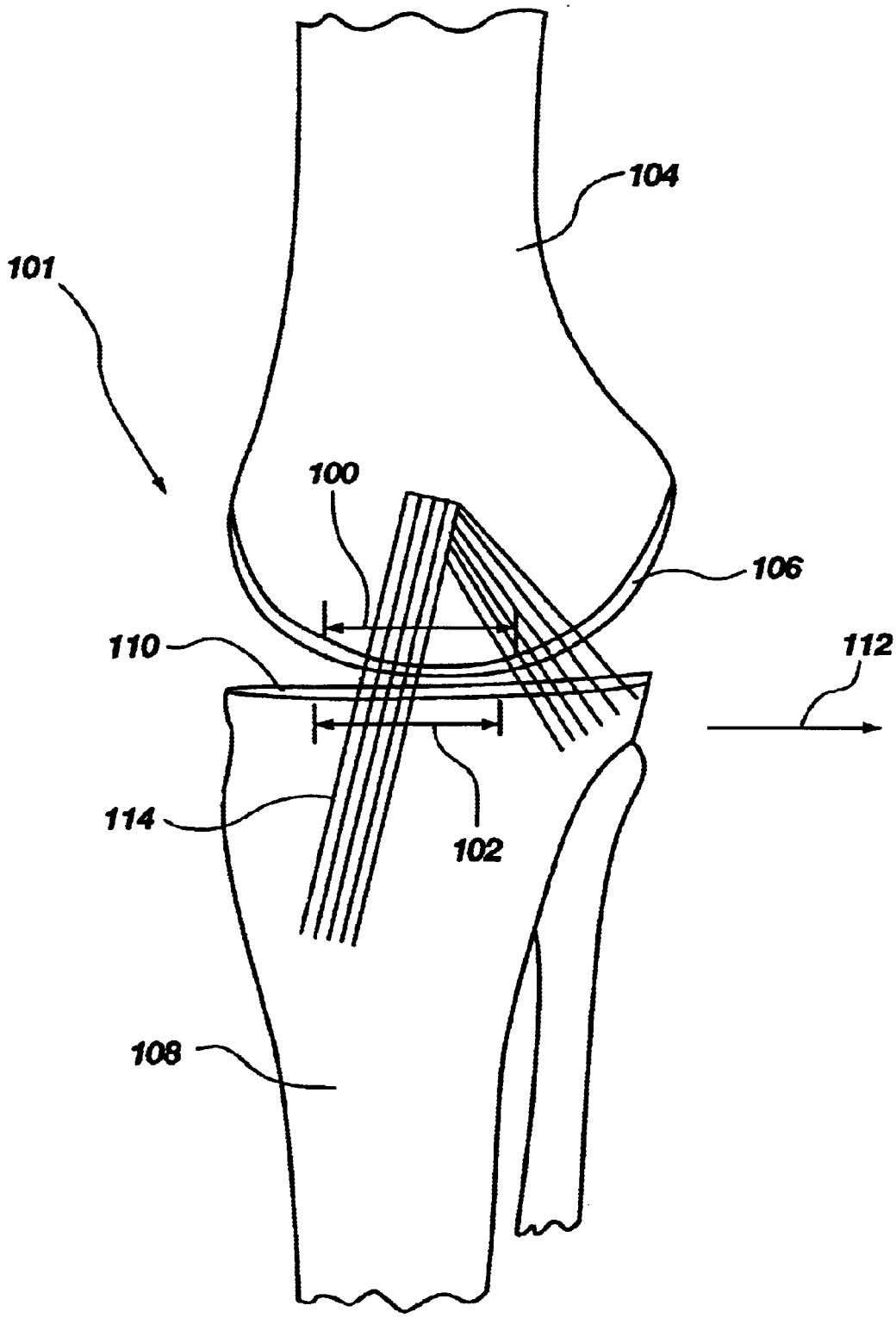
FIG. 7 is a schematic, break-away view of a human knee joint, shown in a position of extension.
Figure 8:
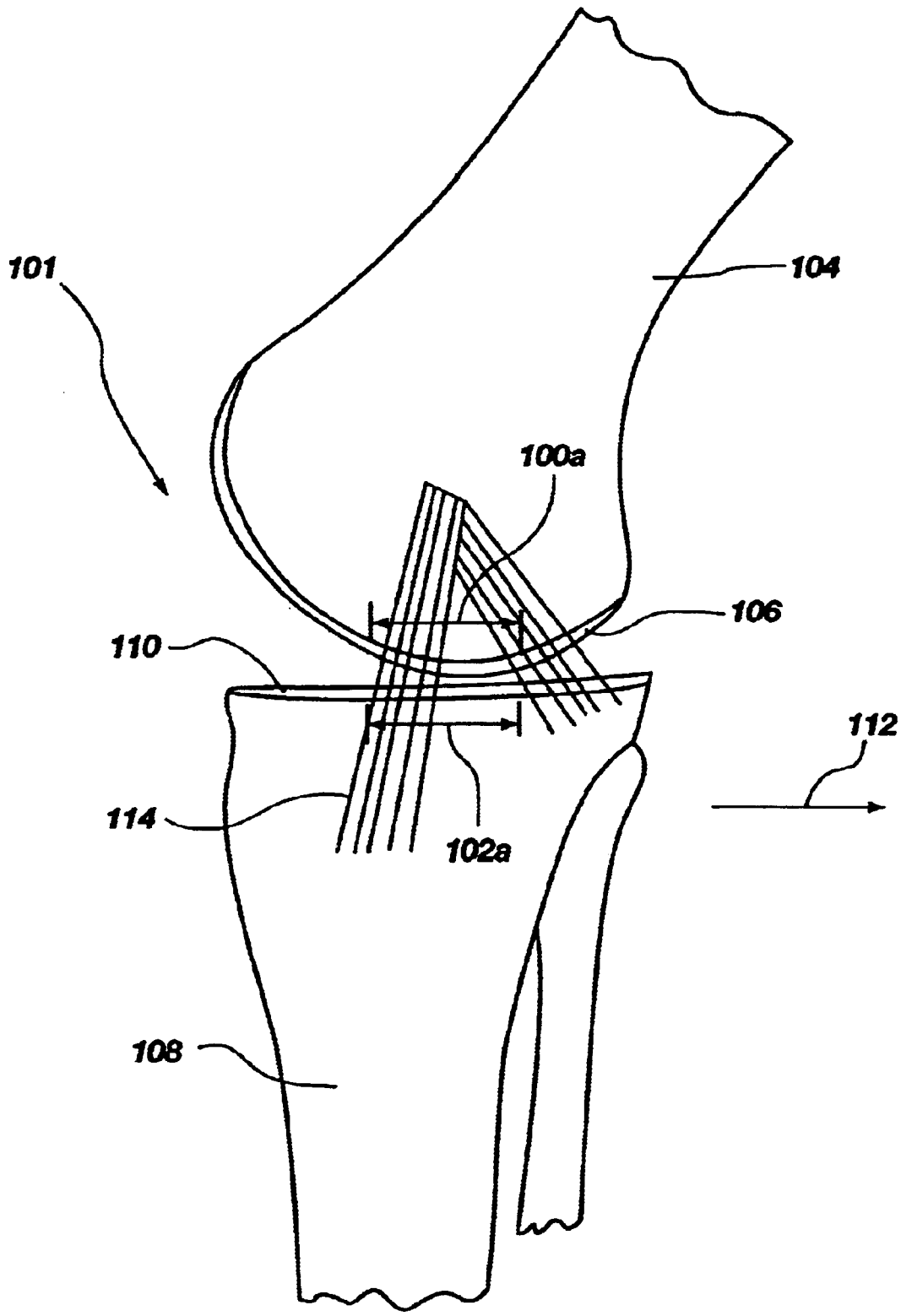
FIG. 8 is a schematic, break-away view of the knee joint of FIG. 7, shown in a position of 30° flexion.
Figure 9:
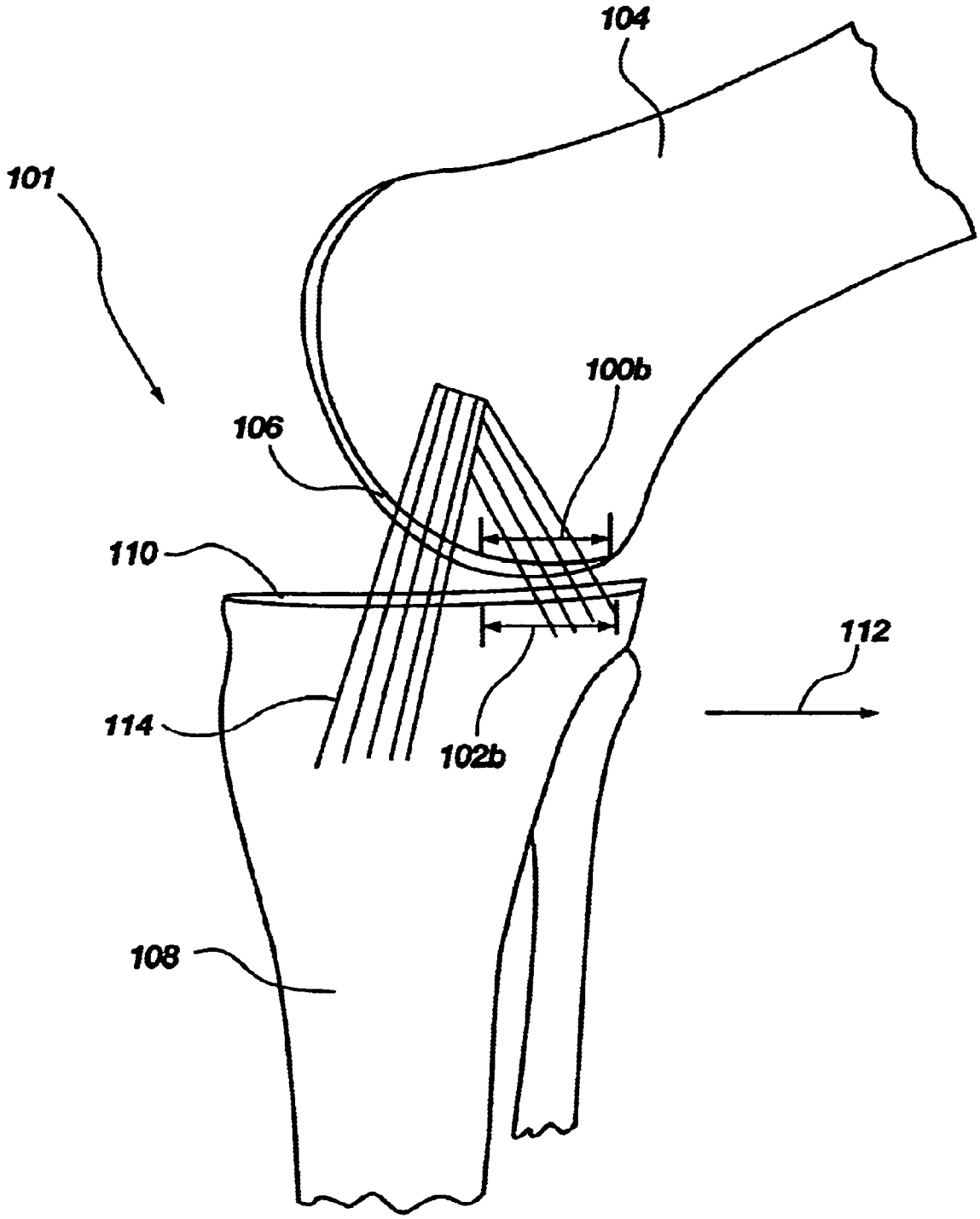
FIG. 9 is a schematic, break-away view of the knee joint of FIG. 7, shown in a position of 70° flexion.

Various degrees of knee flexion are shown in FIGS. 7–9, with correspondingly different compression loading zones. In FIG. 7 is shown a knee joint 101 that resides in extension, which is a 0° flexion position, with upper and lower compression loading zones shown at 100 and 102, respectively. The knee joint 101 includes a femur 104 with femoral articular cartilage 106, and a tibia 108 with tibial articular cartilage 110. The articular cartilage 106 and 110 reside in compression in the loading zones 100 and 102. In FIG. 8 the knee joint 101 is shown in a 30° flexion position with upper and lower compression loading zones 100*a* and 102*a*, and in FIG. 9 the knee joint 101 is shown in a 70° flexion position with upper and lower compression loading zones 100*b* and 102*b*. The angles expressed are in reference to the position of the femur 104 in comparison to its position in the extension (or 0° flexion) position. The position of the femur 104 in FIG. 8 form a 30° angle with the original position of the femur when it resided in the extension (or 0° flexion) position shown in FIG. 7.

It will be appreciated that the compression loading zone of articular cartilage 106 and 110 moves progressively in the posterior direction 112 as knee flexion increases. For example, the compression loading zone 100*b*/102*b* shown in FIG. 9 when the knee joint 101 resides in a 70° flexion position is more posterior in location than the compression loading zone 100*a*/102*a* shown in FIG. 8 when the knee joint 101 resides in a 30° flexion position. One aspect of the invention is to selectively vibrate the knee through various ranges of flexion. Of course, a particular user may choose to vibrate the knee only while it is flexed to the 30° flexion position, particularly if the compression loading zone at that position of flexion is a weak zone that needs the benefits of vibrational stimulation.

Significant benefits result when the knee joint 101 is held in a position of flexion while it is vibrated. Accordingly, one preferred method of mechanically stimulating a human knee comprises the steps of:

(a) placing a user on a platform 14 (FIG. 1);

(b) bending at least one of the user's knees 101 to a flexed position (FIG. 8); and (c) vibrating the platform to thereby vibrate the knee while said knee is in the flexed position.

It will be appreciated that although FIGS. 7–9 illustrate only three knee flexion positions, the knee may of course reside in any desired degree of flexion while being vibrated, in accordance with the principles of the present invention. For example, the knee may be vibrated while in a 25° flexed position, or a 45° flexed position, or a 70° flexed position, or a 90° flexed position, or a 120° flexed position, or a 150° flexed position. While in flexion, muscles and ligaments of the knee or leg reside in contraction, while the articular cartilage 106 and 110 resides in compression. For example, when the knee joint resides in flexion, the ligaments 114 reside in tension simultaneously with the articular cartilage 106 and 110 residing in compression. Accordingly, an important aspect of the invention is that when the knee is vibrationally stimulated while under such loading conditions, significant benefits occur in the specific cartilage and muscles that bear compressive, tensile and other loads during the vibration.

It may be desirable to have the user assume a squatting position, as known to those knowledgeable in the art of squatting, while residing on the platform 14 (shown in FIG. 1) while said platform 14 is vibrating. Preferably, the user's foot is maintained on the platform 14 while the knee joint 101 is flexed to thereby cause vibrational force from the platform 14 to be transmitted through the user's foot to the knee joint 101 that is flexed.

There are also benefits of flexing other joints in the user's body during vibration on the platform 14 and/or when grasping the rails 18. For example, when the knee joint 101 is flexed, the ankle and hip of the user will also necessarily flex, and the muscles, ligaments and other items that bear loading as a result of such flexion can be benefitted by being vibrated during such flexion. A user's wrist, elbow, shoulder and other upper joints and features likewise benefit when vibrated while they reside in flexion, for example by flexing such joints and simultaneously grasping the rails 18 to impart vibration to them. The benefits of vibrating a human joint that resides in a flexion position are profound, and are in accordance with the principles of the present invention.

It is further to be understood that the principles of the present invention are sufficiently broad to include a method of mechanically stimulating a human knee comprising the steps of:

(a) placing a user in contact with a vibration apparatus;

(b) moving at least one of the user's joints to a flexed position; and (c) vibrating the apparatus to thereby vibrate said at least one of the user's joints while said joint is in the flexed position.

It is further to be understood that the "vibration apparatus" of step (a) in the immediately preceding method above may comprise any apparatus capable of imparting vibrational movement to a human user. For example, if desired, a device limited to vibrating handrails 18 and thus lacking the vibrating platform 14, although not preferred, is within the scope of the present invention, as is any other device capable of imparting vibration. The immediately preceding method above may be further augmented with additional aspects.

For example, step (b) may further comprise moving said at least one of the user's joints to a position such that some elements of or associated with the joint reside in compression and other elements of or associated with the joint reside in tension, and wherein step (c) further comprises vibrating the apparatus to thereby vibrate said elements of or associated with the joint that reside in compression and tension.

As a further example, step (b) may further comprise selecting a joint that is part of a limb of the user, identifying a compression loading zone of said joint that is in need of vibrational stimulation and that corresponds to a particular degree of flexion of said joint at a flexion position, and bending the joint to that flexion position, and wherein step (c) further comprises placing said limb in contact with the vibration apparatus and vibrating said apparatus to thereby transmit vibrational loading forces through the limb and into the joint while said joint resides in said flexion position.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An apparatus for mechanically stimulating a human body comprising:

a base frame designed for placement on a floor surface;

a plurality of support blocks fixedly connected to and extending upwardly from said base frame, said support blocks comprising a top part, cam follower means, and a horizontal shaft receptacle, said cam follower means being disposed below said top part and configured for causing vertical reciprocal motion of said top part when subjected to axial rotation by a horizontal shaft disposed in said horizontal shaft receptacle;

at least two parallel horizontal rotatable shafts having a connection end and a drive end, the connection ends of said shafts being disposed in the horizontal shaft receptacles of said plurality of support blocks;

a first group of at least two horizontally planar parallel rails oriented perpendicular to said horizontal rotatable shafts, said first rails having a bottom surface and a top flange, said bottom surface being fixedly connected to the top part of said support blocks and supported thereby;

a second group of at least two horizontally planar parallel rails disposed above and perpendicular to said first rails, said second rails having a bottom flange, a top surface, and a length greater than the greatest distance between any two of the first rails;

slidable connection means connecting the top flange of said first rails to the bottom flange of said second rails, whereby the first rails and second rails may freely slide in orthogonal horizontal directions relative to each other, said slidable connection means being configured to maintain positive connection between said rails when subjected to rapid vertical reciprocation;

a substantially horizontal rigid plate having a top surface, a bottom surface, and having an area sufficient to support a standing human, the bottom surface of said plate being fixedly connected to the top surface of said second rails;

variable speed rotational drive means connected to the drive ends of said rotatable shafts, whereby rotational motion may be imparted to said shafts so as to cause vertical reciprocation of the top part of said support blocks and attached structure;

variable speed orbital drive means connected to the bottom surface of said rigid plate whereby the plate may be caused to oscillate in an orbital manner by sliding upon said rails;

at least one handrail extending upwardly from the first group of at least two horizontally planar parallel rails for grasping by a user standing on the top of the plate; and frequency control means attached to said at least one handrail whereby a user may selectively and independently adjust the speed and operation of the rotational drive means and of the orbital drive means.

2. The apparatus as described in claim 1, wherein the at least one handrail is fixedly connected to and extends upwardly from said first rail, whereby vertical oscillation may be transmitted to the upper body of a user when the handrail is grasped.

3. The apparatus as described in claim 1, wherein said cam follower means are configured to produce vertical reciprocation having an amplitude of less than 2.0 mm.

4. The apparatus as described in claim 3, wherein said vertical reciprocation has an amplitude of from 0.25 to 1.0 mm.

5. The apparatus as described in claim 1, wherein the frequency of the vertical reciprocation and the horizontal oscillations are in the range of from 0 Hz to 100 Hz.

6. The apparatus as described in claim 5, wherein the frequency of the vertical reciprocation is in the range of from 15 Hz to 60 Hz, and the frequency of the horizontal oscillations is in the range of from 0 Hz to 60 Hz.

7. An apparatus for mechanically stimulating a human user comprising:

a base frame;

a support means movably mounted on the base frame for receiving and supporting a human user, said support means comprising a rigid platform, and a rigid handrail having a lower end attached beneath the rigid platform;

horizontal vibration means for causing horizontal vibrational movement of the support means to thereby vibrate a human user supported on the platform;

vertical vibration means for causing vertical vibrational movement of the support means to thereby vibrate a human user supported on the platform;

control means for selectively adjusting a frequency of the horizontal vibrational movement and of the vertical vibrational movement;

wherein the vertical vibration means further comprises push-up means disposed on the base frame for alternately pushing the rigid platform upwardly and bringing said platform downwardly with respect to the base frame; wherein the horizontal vibration means further comprises:

rotational movement means disposed between the push-up means and the rigid platform for permitting rotational movement of the platform with respect to said vertical vibration means; and means for rotating the rigid platform with respect to the base frame;

wherein the rotational movement means comprises a first set of rails fixedly attached to the push-up means, and a second set of rails slidably disposed between the first set of rails and the rigid platform such that said second set of rails are slidable relative to the first set of rails and with respect to the platform;

wherein the apparatus further comprises a handrail attached to the first set of rails and extending upwardly therefrom.

8. The apparatus of claim 7, wherein the rails in the first set of rails are disposed parallel to each other, and wherein the rails in the second set of rails are disposed parallel to each other.

9. The apparatus of claim 8, wherein the platform has a cross-sectional area of less than nine square feet, and wherein an uppermost portion of the handrail resides less than ten feet from the ground when the base frame is on the ground.

10. The apparatus of claim 9, wherein the horizontal vibration means and the vertical vibration means each further comprise a fixed-setting means for providing a constant vibrational amplitude and frequency and thus characterized by an absence of feedback control adjustment of said vibrational amplitude and frequency.

11. The apparatus of claim 10, wherein the horizontal vibration means further comprises means for imparting horizontal vibration having an amplitude of less than 4.0 mm.

12. The apparatus of claim 11, wherein the horizontal vibration means and the vertical vibration means each comprises means for producing vibrational movement at a frequency of less than 500 Hz.

* * * * *